US006679747B1

(12) United States Patent
Chen et al.

(10) Patent No.: US 6,679,747 B1
(45) Date of Patent: Jan. 20, 2004

(54) CONDUCTING CARRIER OF SAND BLASTING DEVICE FOR REMOVING ELESTROSTATIC CHARGE GENERATED DURING SAND BLASTING PROCESS

(75) Inventors: Ming-Shui Chen, Sanchung (TW); Kuo-Pin Hsu, Chu-Pei (TW)

(73) Assignee: AU Optronics Corp., Hsin-Chu (TW)

( * ) Notice: Subject to any disclaimer, the term of this patent is extended or adjusted under 35 U.S.C. 154(b) by 553 days.

(21) Appl. No.: 09/636,556

(22) Filed: Aug. 11, 2000

(51) Int. Cl.[7] ..... H01J 9/10; H01J 9/16; H01J 9/46

(52) U.S. Cl. ..... 445/60; 445/24

(58) Field of Search ..... 445/60, 24, 2

(56) References Cited

U.S. PATENT DOCUMENTS 5,860,843 A * 1/1999 Kasahara ..... 445/24

6,129,827 A * 10/2000 Nakazawa et al. ..... 204/508

FOREIGN PATENT DOCUMENTS

| | | | | |
|---|---|---|---|---|
| JP | 2002028870 A | * | 1/2002 | ..... B24C/5/04 |
| JP | 2003165055 A | * | 6/2003 | ..... B24C/9/00 |
| KR | 2001078593 A | * | 8/2001 | ..... H01J/8/24 |

* cited by examiner

*Primary Examiner*—Sandra O'Shea
*Assistant Examiner*—Peter Macchiarolo
(74) *Attorney, Agent, or Firm*—Winston Hsu

(57) ABSTRACT

A sand blasting device utilized in a sand blasting process has a base, a passageway installed on the base, and a sand blasting nozzle installed above the passageway. A conducting carrier is mounted on the passageway and is capable of sliding along the passageway. The conducting carrier has a plate for supporting a substrate needing to be sand blasted, and a pair of first and second electrically conducting clippers respectively installed on a first side and a second side of the plate for fixing the substrate to the plate and removing electrostatic charges generated during the sand blasting process.

6 Claims, 4 Drawing Sheets

CONDUCTING CARRIER OF SAND BLASTING DEVICE FOR REMOVING ELESTROSTATIC CHARGE GENERATED DURING SAND BLASTING PROCESS

BACKGROUND OF THE INVENTION

1. Field of the Invention

The present invention relates to a conducting carrier, and more specifically, to a conducting carrier of a sand blasting device for removing electrostatic charges generated during a sand blasting process.

2. Description of the Prior Art

Plasma display panels (PDP) have large, wide screens and are thin and light. By utilizing ultraviolet light produced by gas discharge to irradiate fluorescent materials in thousands of display elements, red, green and blue lights can be generated and therefore emitted on the PDP. During the formation a back substrate of the PDP, a plurality of barrier ribs, having shapes of either stripes, cells or other shapes due to product requirement, needs to be formed to define each display element before the fluorescent materials are formed on the substrate, so as to prevent the mixing of different fluorescent materials. The width and height of the barrier ribs respectively range from 50 to 80 $\mu$m and from 150 to 220 $\mu$m, making the barrier ribs very difficult to be formed. Conventional methods of making barrier ribs include printing, photoresist sand blasting, and additive methods. The photoresist sand blasting method combines a photo etching technology and a sand blasting process to achieve precise patterns of the barrier ribs with smaller sizes, and has therefore become the most popular way of making barrier ribs. However, electrostatic charges frequently produced during the sand blasting process are not easily to be moved, therefore leading to a great impact on the quality of the PDP.

Please refer to FIGS. 1 to 4 of schematic views of making a plurality of barrier ribs 20 of a PDP on a back substrate 10 by using a photoresist sand blasting method according to the prior art. As shown in FIG. 1, a plurality of electrodes 12, a protective layer 14 and a barrier rib material layer 16 are sequentially formed on a glass substrate 11. The protective layer 14 is a dielectric layer employed to cover the surface of the glass substrate 11 and the electrodes 12, so as to prevent the electrodes 12 from being damaged in subsequent sand blasting processes. The barrier rib material layer 16 is a dielectric layer composed of low melting point glass and oxides, such as aluminum oxide. As shown in FIG. 2, a photoresist layer 18 is then formed on a predetermined area of the barrier rib material layer 16 by performing exposure and development processes to define the barrier ribs 20. As shown in FIG. 3, a sand blasting process is performed to remove portions of the barrier rib material 16 not covered by the photoresist layer 18 down to the surface of the protective layer 14. As shown in FIG. 4, the photoresist layer 18 is removed, and the residual barrier rib material layer 16 is baked to form a plurality of barrier ribs 20 at a temperature of higher than 500° C. to complete the formation of the barrier ribs 20 of the PDP.

The sand blasting process is performed in a sand blasting device (not shown). Portions of the barrier rib material layer 16 uncovered by the photoresist layer 18 is removed by an abrasive sand jetted on the back substrate 10 against the barrier rib material layer 16. However, electric charges are frequently generated and are therefore accumulated on the surface of the barrier rib material layer 16, causing electrostatic discharge during the sand blasting process.

Furthermore, the electric charge can be accumulated on the electrodes 12 under the barrier rib material layer 16. When the accumulated charges increase to a certain amount, tip discharging would occur within a gap (not shown) between two neighboring electrodes. As a result, arcing would occur between electrodes when the finished PDP is turned on, leading to appearance of numerous irregularly black spots on the PDP panel.

SUMMARY OF THE INVENTION

Therefore, it is a primary objective of the present invention to provide a conducting carrier for a sand blasting process, so as to remove electrostatic charges during the sand blasting process.

In the preferred embodiment of the present invention, the sand blasting process is performed by utilizing a sand blasting device. The sand blasting device has a base, a passageway installed on the base, and a sand blasting nozzle installed above the passageway. The conducting carrier is mounted on the passageway and is capable of sliding along the passageway. The conducting carrier has a plate for supporting a substrate to be sand blasted, and two electrically conducting clippers respectively installed on a first side and a second side of the plate for fixing the substrate to the plate. Electrostatic charges generated during the sand blasting process are capable of being removed from the surface of the substrate by the clippers.

It is an advantage of the present invention that the conducting carrier is utilized to remove electrostatic charges, and thus prevents accumulation of electrostatic charges in gaps between electrodes on the substrate, enhancing the quality of the substrate.

These and other objectives of the present invention will no doubt become obvious to those of ordinary skill in the art after reading the following detailed description of the preferred embodiment, which is illustrated in the various figures and drawings.

DETAILED DESCRIPTION OF THE INVENTION

Figure 1:
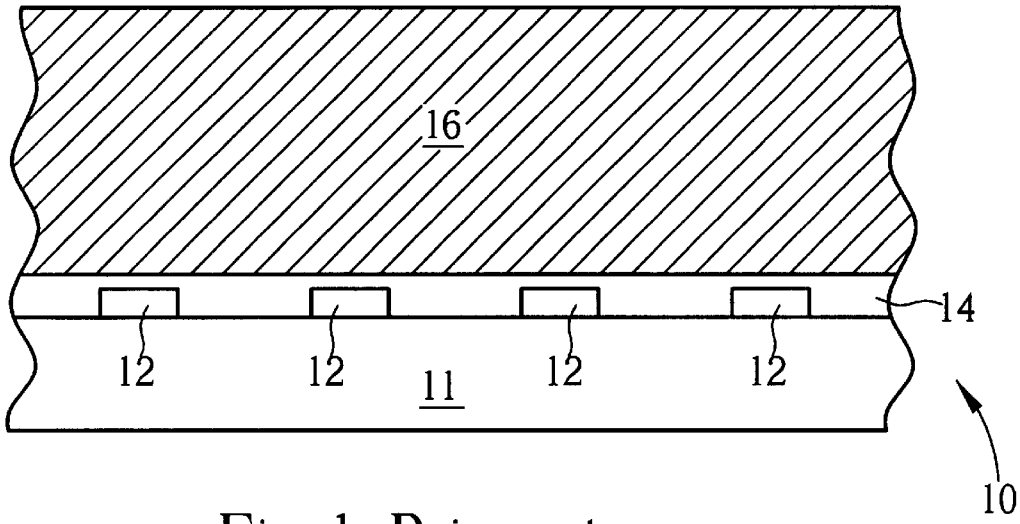
Fig. 1 Prior art
FIGS. 1 through 4 are schematic views of making barrier ribs of a plasma display panel (PDP) according to the prior art.
Figure 2:
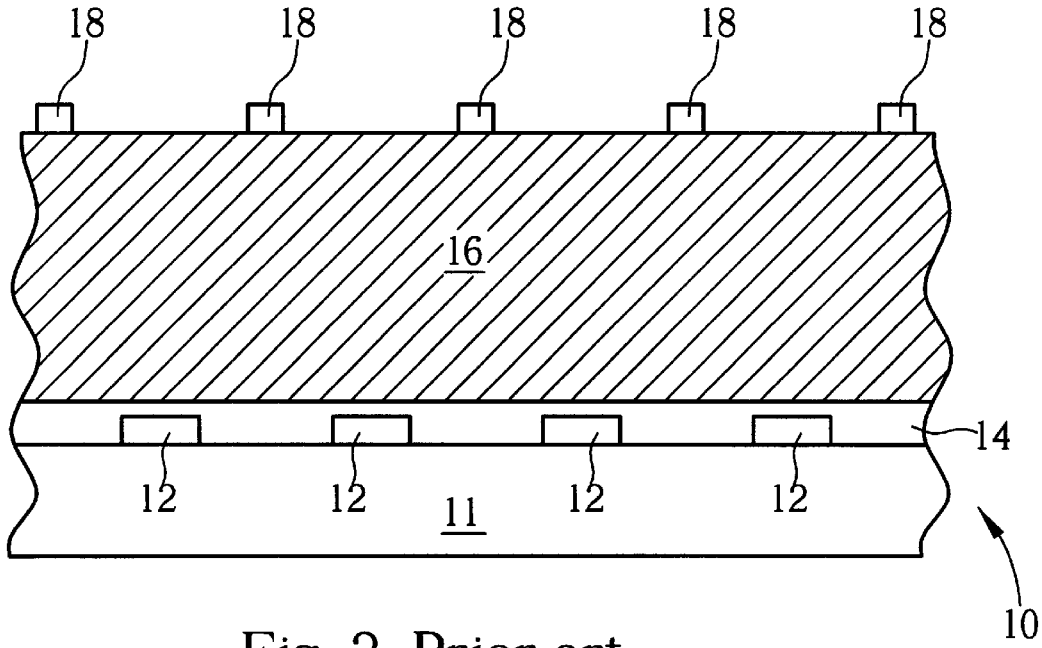
Fig. 2 Prior art
Figure 3:
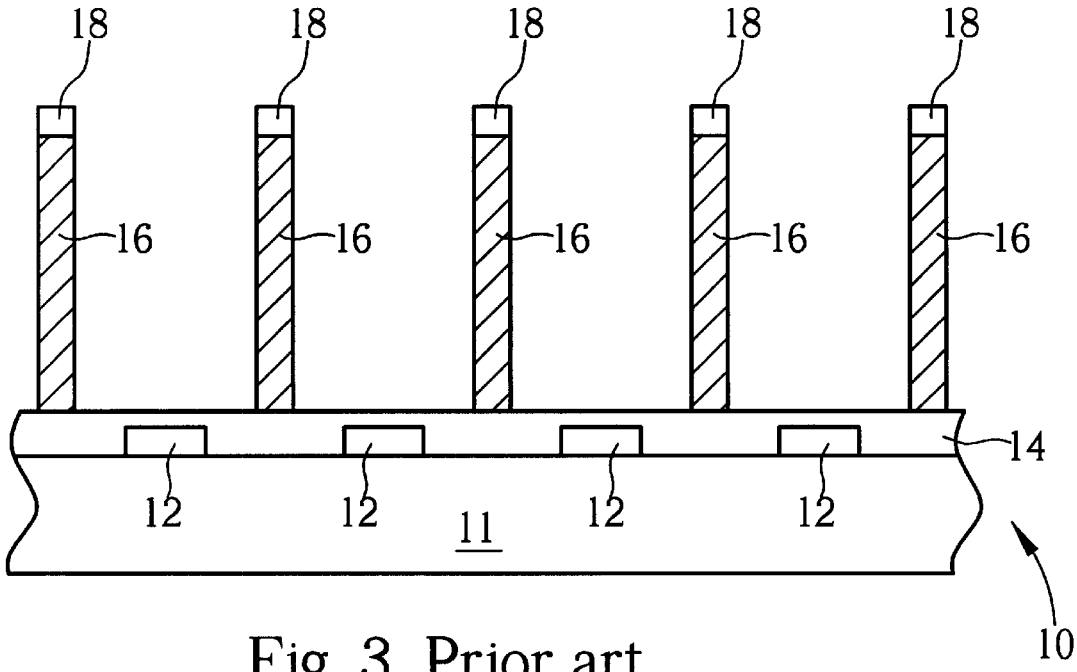
Fig. 3 Prior art
Figure 4:
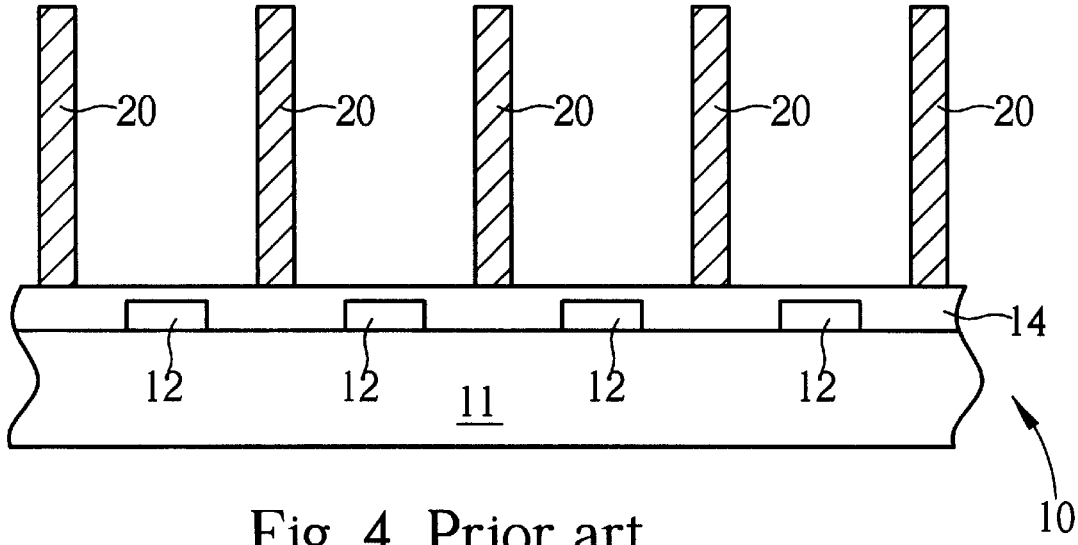
Fig. 4 Prior art
Figure 5:
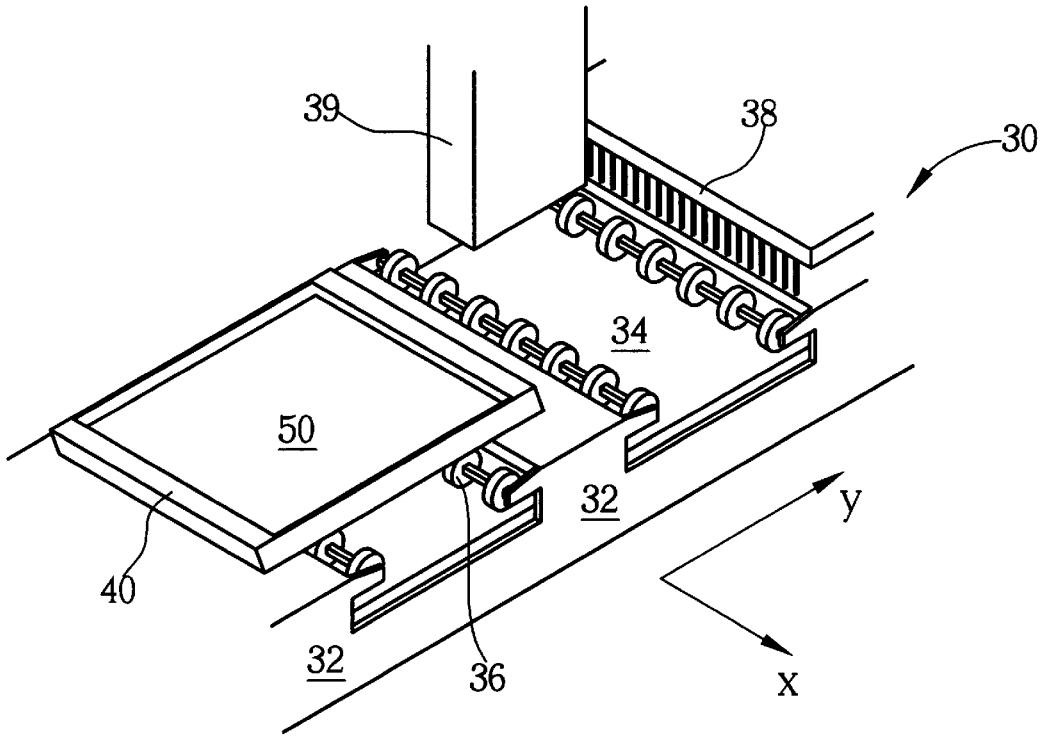
FIG. 5 is the schematic view of a conducting carrier disposed within a sand blasting device according to the present invention.

Please refer to FIG. 5, which is a schematic view of a conducting carrier 40 disposed within a sand blasting device 30 according to the present invention. As shown in FIG. 5, the conducting carrier 40 is used to support a back substrate 50 of a plasma display panel (PDP) and to remove electrostatic charges generated on the back substrate 50 during a sand blasting process performed by using the sand blasting device 30.

As shown in FIG. 5, the sand blasting device 30 comprises a base 32, a passageway 34 on the base 32, a plurality of rollers 36 installed on the passageway 34, a grounded conducting brush 38 installed above the passageway 34, and a nozzle 39 installed above the passageway 34 for jetting out sand towards the back substrate 50 during the sand blasting process.

During the sand blasting process, the plurality of rollers 36 is employed to enable the conducting carrier 40 to slide along the passageway 34 in the y direction. Simultaneously, the nozzle 39 moves back and forth along the x direction and jets out sand towards the back substrate 50 disposed on the conducting carrier 40. The grounded conducting brush 38 is employed to contact with both the surface of the back substrate 50 and a first and a second conducting clippers 44 and 45 after the conducting carrier 40 and the back substrate 50 pass beneath the nozzle 39, and thus to remove electrostatic charges generated on the surface of the back substrate 50 and on the plurality of the first and second electrodes 53 and 54 during the sand blasting process.

Figure 6:
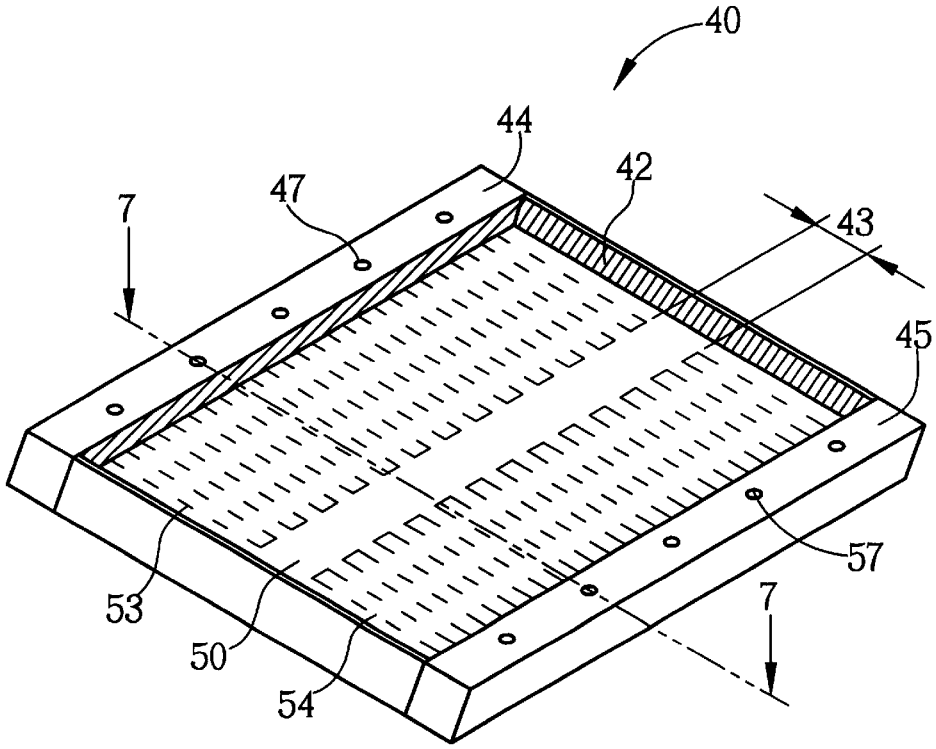
FIG. 6 is a top view of the conducting carrier 40 shown in FIG. 5.
Figure 7:
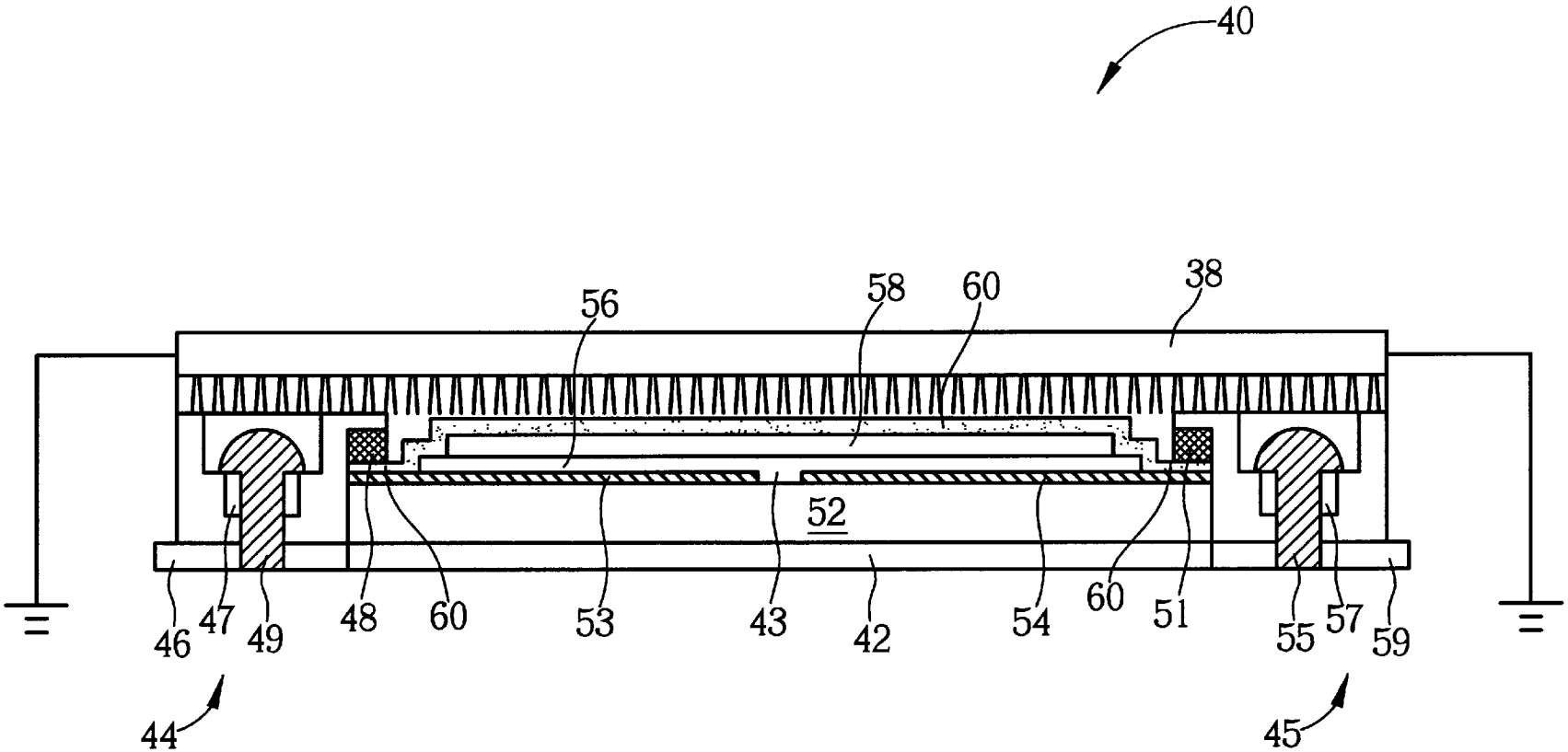
FIG. 7 is a cross-sectional view of the conducting carrier 40 shown in FIG. 6 along the 7—7 axis.

Please refer to FIG. 6 and FIG. 7. FIG. 6 is a top view of the conducting carrier 40 shown in FIG. 5, and FIG. 7 is a cross-sectional view of the conducting carrier 40 shown in FIG. 6 along the 7—7 axis. As shown in FIG. 6, the conducting carrier 40 comprises a plate 42 for supporting the back substrate 50, and the first and second electrically conducting clippers 44 and 45 installed on both sides of the plate 42, respectively, for fixing the back substrate 50 onto the plate 42. The first electrically conducting clipper 44 comprises a metal frame 46, a soft conducting layer 48 installed under the metal frame 46, and a plurality of lock holes 47 provided in the metal frame 46. Similarly, the second electrically conducting clipper 45 comprises a metal frame 59, a soft conducting layer 51 installed under the metal frame 59, and a plurality of lock holes 57 provided in the metal frame 59. The plate 42 is composed of a stainless material to protect the electrodes formed on the surface of the back substrate 50.

The back substrate 50 comprises a glass substrate 52, a plurality of first electrodes 53 and a plurality of second electrodes 54, a protective layer 56 covering the glass substrate 52 and the electrodes 53 and 54, a barrier rib material layer 58 formed on the protective layer 56, and a photoresist layer 60 covering a predetermined area on the surface of the barrier rib material layer 58. The electrodes 53 and 54 are disposed on the glass substrate 52 in a dual-scan manner. In other words, the first electrodes 53 are disposed in parallel along the left side of the top surface of the glass substrate 52 while the second electrodes 54 are disposed in parallel along the right side of the top surface of the glass substrate 52. Each first electrode 53 formed on the left side has one corresponding second electrode 54 formed on the right side, and a width of a gap 43 between each pair of first electrode 53 and the corresponding second electrode 54 is approximately 100 $\mu$m.

The sand blasting process is disclosed as below. First, the back substrate 50 is placed on the plate 42 of the conducting carrier 40 having the first and second electrically conducting clippers 44 and 45 are installed on the opposite sides of the plate 42. A plurality of screws 49 and 55 are then respectively fixed into all the lock holes 47 and 57 so as to clamp the back substrate 50 onto the plate 42. Thereafter, the soft conducting layer 48 of the first conducting clipper 44 is contacted with a first portion of the photoresist layer 60 formed above all the first electrodes 53. In a similar manner, the soft conducting layer 51 of the second conducting clippers 45 is contacted with a second portion of the photoresist layer 60 formed above all the second electrodes 54. It is noticed that these two soft conducting layers 48 and 51 are not directly contacted with each electrode 53 and 54, since the thickness of the photoresist layer 60 is only 40 $\mu$m, the distance between the two soft conducting layers 48 and 51 and the first and second electrodes 53 and 54, respectively, is approximately 40 $\mu$m, which is much smaller than the width of the gap 43 formed between each pair of the first and the second electrodes, which is approximately 100 $\mu$m. Electrostatic charges generated on the electrodes 53 and 54 during the sand blasting process are thus conducted through the photoresist layer 60 to the two soft conducting layers 48 and 51 of the two electrically conducting clippers 44 and 45, and further to the grounded conducting brush 38 contacted with the electrically conducting clippers 44 and 45. As a result, all the electrostatic charges formed on the first electrodes 53 and the second electrodes 54 are removed, preventing accumulation of electrostatic charge at the neighboring tips adjacent to the gaps 43 that frequently leads to tip discharging and arcing phenomena.

As previously mentioned, the plate 42 of the conducting carrier is made of stainless steel, and the rollers 36, which is optionally grounded, on the sand blasting device 30 can be made of a conductive plastic material. The conducting carrier 40 supports the back substrate 50 and is disposed on the rollers 36, sliding along the y direction during the sand blasting process. Since the metal plate 42 is in contact with the rollers 36, electrostatic charges accumulated on the plate 42, and the first and second conducting clippers 44 and 45 are therefore by the rollers 36.

As the conducting carrier 40 passes beneath the electrically conducting brush 38, the grounded conducting brush 38 simultaneously contacts the surface of the back substrate 50 and the conducting clippers 44 and 45. Thus, electrostatic charges formed on the back substrate 50 are removed, leading to an improved quality of the back substrate 50 of the PDP.

In comparison with the prior art, the present invention introduces the conducting carrier 40 to enable one end of each electrode to be conducted with the soft conducting layer 48 or 51, making the electrodes grounded. Thus, no electrostatic charge accumulates in the gaps 43 between any two neighboring electrodes.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An conducting carrier for removing electrostatic charges generated on a substrate, the substrate having a plurality of isolated first electrodes disposed along a first edge of the substrate, and a plurality of isolated second electrodes disposed along a second edge of the substrate, the conducting carrier comprising:

a plate for supporting the substrate, the plate having a first side and a second side, when the substrate being supported by the plate, the first side of the plate being close to the first edge of the substrate, and the second side of the plate being close to the second edge of the substrate;

a first conducting clipper positioned at the first side of the plate for simultaneously fixing the substrate onto the plate and conducting the plurality of first electrodes to a ground node; and a second conducting clipper positioned at the second side for simultaneously fixing the substrate onto the plate and conducting the plurality of second electrodes to the ground node, wherein when the substrate is fixed by the first and the second conducting clippers, the plurality of first and second electrodes are grounded so that the electrostatic charges produced during a sand blasting process are carried away from the first and second electrodes.

2. The conducting carrier of claim 1 further comprising a conducting brush installed above and contacting the first and second conducting clippers, so that the conducting brush conducts the first and second conducting clippers to the ground node.

3. The conducting carrier of claim 2 wherein the conducting brush contacts the surface of the substrate so as to carry away electrostatic charge thereon.

4. The conducting carrier of claim 1 wherein the plate is made of metal and supported by a plurality of rollers positioned below the plate, the rollers are made of conducting plastic and are grounded so that electrostatic charge generated on the substrate can be carried away through the rollers.

5. The conducting carrier of claim 1 wherein each conducting clipper comprises:

a metal base; and a soft conducting layer positioned under the metal base and used for conducting the plurality of the first and second electrodes of the substrate.

6. The conducting carrier of claim 1 wherein the substrate is a panel of a plasma display panel (PDP), and the sand blasting process is employed to make barrier ribs on the panel.

* * * * *